US006648303B1

(12) United States Patent
Nishimoto et al.

(10) Patent No.: US 6,648,303 B1
(45) Date of Patent: Nov. 18, 2003

(54) CONTROL DEVICE FOR HYDRAULIC DRIVE WINCH

(75) Inventors: Yoshio Nishimoto, Kobe (JP); Takahiro Kobayashi, Akashi (JP); Taisuke Tsunoo, Akashi (JP); Etsujiro Imanishi, Kobe (JP); Satoshi Yonezawa, Kobe (JP)

(73) Assignee: Kolbelco Construction Machinery Co., Ltd., Hiroshima (JP)

( * ) Notice: Subject to any disclaimer, the term of this patent is extended or adjusted under 35 U.S.C. 154(b) by 280 days.

(21) Appl. No.: 09/703,720

(22) Filed: Nov. 2, 2000

(30) Foreign Application Priority Data

Nov. 25, 1999 (JP) ..... 11-333910
Jul. 13, 2000 (JP) ..... 2000-212746

(51) Int. Cl.[7] ..... B66D 1/08
(52) U.S. Cl. ..... 254/361
(58) Field of Search ..... 254/360, 361

(56) References Cited

U.S. PATENT DOCUMENTS 3,818,802 A 6/1974 Wilson
6,079,576 A 6/2000 Bosler et al.

FOREIGN PATENT DOCUMENTS

| | | |
|---|---|---|
| DE | 34 41 185 | 5/1986 |
| DE | 199 62 648 | 7/2000 |
| JP | 63-35555 | 7/1988 |
| JP | 11-79679 | 3/1999 |
| JP | 11 079 679 | 3/1999 |

*Primary Examiner*—Emmanuel Marcelo
(74) *Attorney, Agent, or Firm*—Oblon, Spivak, McClelland, Maier & Neustadt, P.C.

(57) ABSTRACT

A winding-down side pilot port of a control valve is of a 2-port construction comprising a normal winding-down side port having a large pressure receiving area and a free fall side port having a small pressure receiving area, wherein in the free fall operation carried out by setting a motor to a small capacity, a pilot pressure of a winding-down side remote control valve is supplied to the free fall side port through a mode switching valve. Thereby, a stroke of the control valve can be suppressed so that a speed of a motor does not exceed an allowable speed.

12 Claims, 15 Drawing Sheets

RELATION BETWEEN PILOT PRESSURE AND MOTOR CAPACITY

CONTROL DEVICE FOR HYDRAULIC DRIVE WINCH

BACKGROUND OF THE INVENTION

1. Field of the Invention

The present invention relates to a control device for a hydraulic drive winch for controlling rotation of a winch drum driven by a hydraulic motor.

2. Description of the Related Art

A conventional control device for a hydraulic drive winch is shown in Japanese Patent Application Laid-Open No. 63-35555 Publication. That is, in the aforesaid device, a winch drum is provided with a clutch, and both negative and positive brakes. These clutch and brakes are on/off controlled according to the operating conditions of drum drive and stop, and free fall (free fall of suspended load). For the free fall, the clutch, the positive brake and a control system for them are necessary. This poses a problem that the device constitution becomes complicated, and the cost is high.

So, we have proposed a device for eliminating the clutch and brakes for the free fall. This device is shown in Japanese Patent Application Laid-Open No. Hei 11-79679 Publication. By setting a motor to a small capacity during the free fall operation, the winch drum can be wound down and rotated at high speeds.

Incidentally, a hydraulic pump, which is a hydraulic source for a hydraulic motor, is not exclusively used for a winch but is used in common as a hydraulic source for a plurality of actuators. Therefore, the engine speed is changed by the total of loads of the actuators. The pump flow rate is changed by the change of the engine speed. The motor flow rate is changed accordingly. The motor flow rate is changed at a position of the same control valve during the free fall operation. Therefore, when the engine speed is risen, the motor speed exceeds the allowable speed so that there sometimes possibly occurs the situations such that the winding-down speed is excessively high, and the random winding occurs.

As the winding-down operating means for operating the control valve on the winding-down side, the present inventors have provided, separately from the first winding-down operating means for normal winding-down, the second winding-down operating means for free fall operation. The second winding-down operating means controls the passage flow rate of the control valve so that the flow rate of the hydraulic motor does not exceed the allowable flow rate at the minimum valve of the motor capacity. The passage flow rate of the valve (motor flow rate) is controlled by operating the control valve by the second winding-down operating means during the free fall operation.

Accordingly, the excessive rotation can be prevented while keeping the motor flow rate properly.

In this case, as the winding-down operating means, there are two operating means, i.e., normal winding-down and free fall operation. Therefore, in the operation for continuously carrying out the winding-up operation and the free fall operation, the operation becomes complicated.

Further, where the winch drum is wound down and rotated at high speeds by setting the motor to a small capacity during the free fall operation, the speed when winding-down starts becomes quick as the load of a hanging load increases. Where a rapid lever operation is carried out, a shock possibly occurs in the vehicle body. Furthermore, when the initial speed is high, the movement of a counter balance valve cannot follow the hanging load, and hunting possibly occurs.

SUMMARY OF THE INVENTION

It is a first object of the present invention to provide a control device for a hydraulic drive winch capable of preventing excessive speed of a motor caused by an increase in engine speed during the free fall operation and capable of using winding-down operating means for normal winding-down operation and free fall operation is common.

It is a second object of the present invention to provide a control device for a hydraulic drive winch occurring no shock at the time of starting winding-down because initial speed is low even where a load of a hanging load is heavy and also capable of preventing occurrence of hunting.

The control device for a hydraulic drive winch according to the present invention has the following fundamental constitution. That is, the control device comprises a winch drum, a variable capacity type hydraulic motor for driving the winch drum, a hydraulic pump as a hydraulic source, a control valve for controlling supply and discharge of pressure oil to the hydraulic motor, winding-up side for operating the control valve on the winding-up operating means, motor capacity control means for controlling capacity of the hydraulic motor, and free fall instructing means for outputting free fall instructions. The motor capacity control means is operated on the basis of the free fall instructions from the free fall instructing means to set the hydraulic motor to a small capacity, in which state the winding-down operating means is operated whereby the winch drum is wound down and rotated at high speeds to carry out the free fall operation.

In this case, looseness of a rope and random winding can be prevented.

Preferably, control valve controlling means is provided in addition to the above-described fundamental constitution. The control valve controlling means controls an opening degree of the control valve relative to the operating amount of the winding-down operating means to be smaller than that of the normal winding-down operation without the free fall instructions so that at the time of the free fall operation, the supply flow rate to the hydraulic motor is less than the allowable flow rate of the hydraulic motor.

In this case, at the time of the free fall operation, an opening degree (passage flow rate) of the control valve with respect to the operating amount of the winding-down operating means is throttled. Thereby, the excessive speed of the motor at the time of the free fall operation can be prevented. Accordingly, it is possible to prevent the random winding from occurrence.

In the control device for a hydraulic drive winch according to the present invention, alternatively, the motor capacity control means in the above-described fundamental constitution may employ the following constitution. In this motor capacity control means, the motor capacity is increased on the high engine speed side according to the engine speed for driving the hydraulic pump, whereby at the time of the free fall operation, the hydraulic motor speed is controlled to no more than the allowable speed of the hydraulic motor.

In this case, the motor capacity increase as the engine speed rises. Accordingly, it is possible to prevent the excessive speed of the motor at the time of the free fall operation.

The control device for a hydraulic drive winch may comprise, in addition to the above-described fundamental constitution, free fall control means. The free fall control means changes the capacity of the hydraulic motor from a large capacity to a small capacity in proportional to the operating amount of the winding-down operating means.

In this case, when the free fall operation is selected by the free fall instructing means, a tilting angle of the variable capacity motor is controlled, for example. Thereby, the capacity of the variable capacity motor is set from a large capacity to a small capacity in proportional to the winding-down operating amount. So, when the winding-down operation is carried out using the operating means which is common in operation to the free fall operation, the initial speed of the free fall gets slow since at the time of starting free fall operation, the capacity of the variable capacity motor is large. Accordingly, the free fall operation can be carried out safely.

DESCRIPTION OF THE PREFERRED EMBODIMENTS

Figure 1:
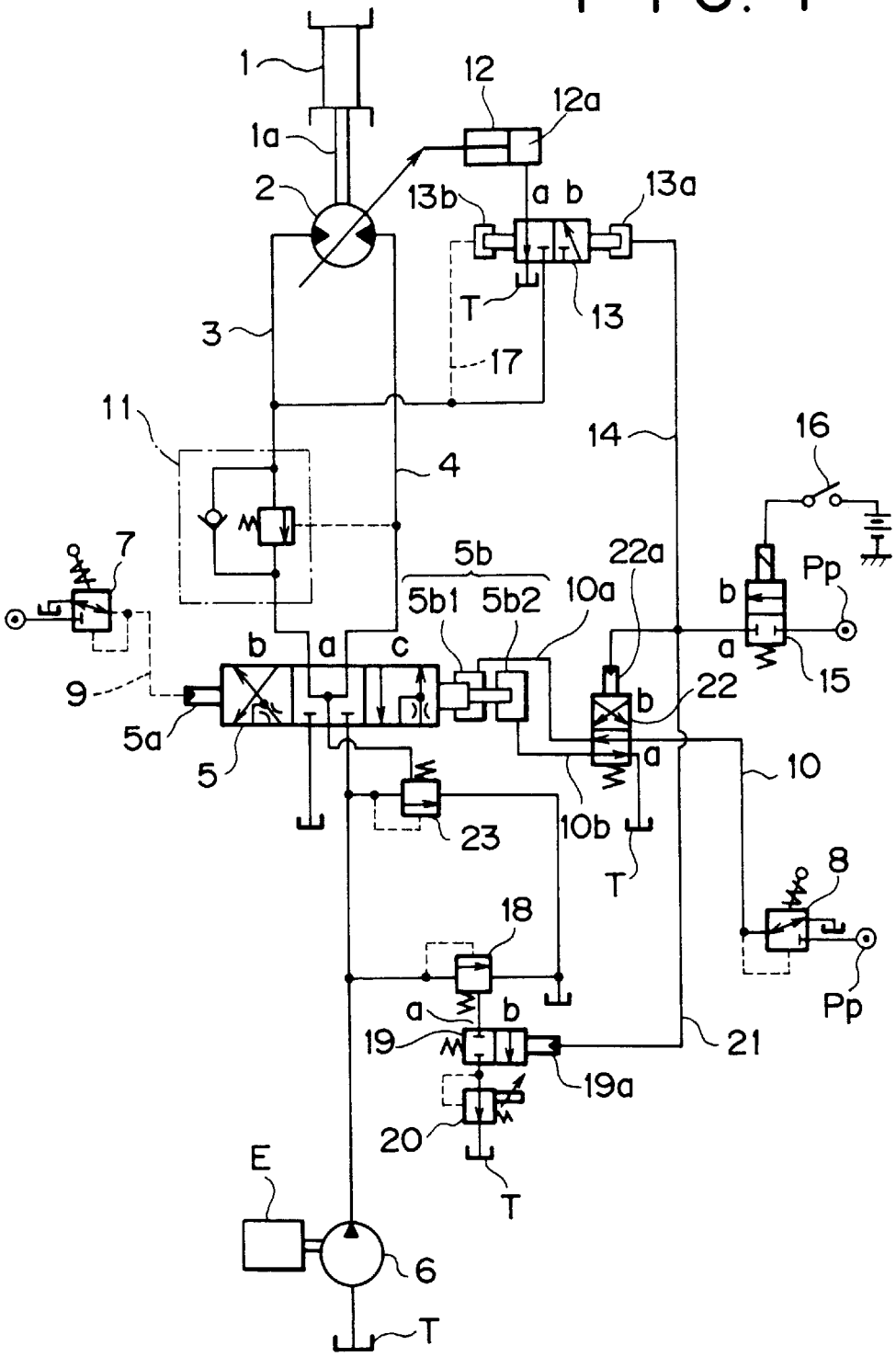
FIG. 1 is a circuit constituent view showing Embodiment 1 of the present invention.

The forms of embodiments of the present invention will be described with reference to FIGS. 1 to 20.

(A) First, a first form of embodiment will be described hereinafter on the basis of Examples 1 to 5.

EXAMPLE 1 (See FIGS. 1 to 5)

Reference numeral 1 denotes a winch drum. A rotational shaft 1*a* of the winch drum 1 is connected directly or through a reduction unit to a hydraulic motor 2 for a winch of a variable capacity type. The winch drum 1 is rotated and driven by the motor 2.

Both winding-up and winding-down pipes 3, 4 constituting a driving circuit of the hydraulic motor 2 are connected to a hydraulic pump 6 through a hydraulic pilot switching type control valve 5 provided with three positions a, b and c, i.e., neutral, winding-up and winding-down. Supply and discharge (drive, stop, and rotating direction and speed at the time of drive) of pressure oil to the motor is controlled by the control valve 5.

Reference numeral 7 denotes a winding-up side remote control valve as winding-up operating means for operating the control valve 5 on the winding-up side. Reference numeral 8 denotes a winding-down side remote control valve as winding-down operating means for operating the control valve 5 on the winding-down side at the time of power winding-down. Pilot pressure according to the operating amount of both the remote control valves 7, 8 is fed to both pilot ports 5*a*, 5*b*on the winding-up side and winding-down side of the control valve 5.

The both the remote control valves 7, 8 on the winding-up side and e th winding-down side, normally, are integrally formed and selectively operated by a single lever.

Reference numeral 11 denotes a counter-balance valve as a brake valve for generating a hydraulic brake force in the winding side pipe 3 at the time of power winding-down rotation. Reference character E denotes an engine for driving the hydraulic pump 6.

Motor capacity control means for controlling capacity of the hydraulic motor 2 will be described.

Reference numeral 12 denotes a cylinder (hereinafter referred to as a capacity regulating cylinder) as a motor capacity regulating actuator for changing a tilting angle of the hydraulic motor 2 to thereby change the motor capacity. The hydraulic motor 2 is set to a large capacity in a state that the cylinder 12 is contracted, and set to a small capacity in a state that the cylinder is extended.

An oil chamber 12*a* on the contracted side of the capacity regulating cylinder 12 is connected to the winding-up side pipe 3 through a cylinder control valve (an actuator control valve) 13 of a hydraulic pilot switching type.

The cylinder control valve 13 has a large capacity position (a) and a small capacity position (b). At the large capacity position (a), an oil chamber 12*a* on the extended side of the cylinder is communicated with a tank T so that the capacity regulating cylinder 12 is contracted (the hydraulic motor 2 is set to a large capacity).

On the other hand, when the control valve 13 is switched to the small capacity position (b), oil in the winding-up side pipe 3 is introduced into the oil chamber 12*a* on the extended side of the cylinder whereby the cylinder 12 is extended (the hydraulic motor 2 is set to a small capacity region).

A small capacity pilot port 13*a* of the cylinder control valve 13 is connected to an output port of a free fall valve (an electromagnetic switching valve) 15 as free fall instruction means through a motor capacity switching line 14.

The free fall valve 15 is set to a non-operation position (a) shown in FIG. 1 at the time of normal operation except the free fall operation. In this state, the cylinder control valve 13 is maintained at a large capacity position (a) shown.

When from that position, the free fall switch 16 is operated, the free fall valve 15 is switched to the operating position (b). Thereby, oil pressure of a pilot hydraulic source Pp is supplied to the small capacity side pilot port 13*a* of the cylinder control valve 13 so that the control valve 13 is switched to a small capacity position (b). Accordingly, the capacity regulating cylinder 12 is operated to be extended, and the hydraulic motor 2 is set to a small capacity.

On the other hand, the large capacity side pilot port 13*b* of the cylinder control valve 13 is connected to the winding-up side pipe 3 by a winding-up side pressure detecting line 17. When the pressure of the pipe 3 rises, the cylinder control valve 13 is operated with respect to the large capacity position (a) side so that the motor capacity increases.

In the following, the pump pressure control means for setting pump pressure to a low level at the time of free fall operation will be described.

Reference numeral 18 denotes a variable relief valve as pump pressure setting means for setting pump pressure. To a spring side pressure port of the relief valve 18 are directly connected a pump pressure-switching valve 19 of a hydraulic pilot type, and a pump pressure setting valve 20. The pump pressure-switching valve 19 is switched to a closed position (a) and an open position (b), vice versa.

A pilot port 19*a* of the pump pressure-switching valve 19 is connected to a pump pressure control line 21. The pump pressure control line 21 is connected to an output port of the free fall valve 15.

Next, when the free fall valve 15 is set to an operating position (b), oil pressure from the pilot hydraulic source Pp is supplied to the pilot port 19*a*. Then, the switching valve 19 is switched from the closed position (a) to the open position (b).

Thereby, set pressure of the relief valve 18, that is, pump pressure is set to a value determined by set pressure of the pump pressure setting valve 20.

The pump pressure determined by the pump pressure setting valve 20 is set to a value at which a relationship between the pump pressure and the winding-down rotating force>drum rotating resistance is established.

In the foregoing constitution, at the time of normal winding-up and winding-down operation, the free fall valve 15 is set to a non-operation opposition (a).

In this state, the motor capacity and the pump pressure are set to a large capacity and a high pressure, respectively. The hydraulic motor 2 is driven at a speed corresponding to the operating amount (stroke of the control valve 5) of both winding-up side and winding-down side remote control valves 7, 8, and normal winding-up and winding-down operation are carried out.

Then, when the free fall operation is carried out, the free fall switch 16 is operated to switch the free fall valve 15 to the operation position (b).

When in that state, the winding-down side remote control valve 8 is operated, the motor capacity and the pump pressure are set to a small capacity and a low pressure, respectively. Thereby, the hydraulic motor is wound down and driven at high speeds to effect the free fall operation.

At this time, an opening degree of the control valve 5 is changed according to the operating amount of the winding-down side remote control valve 8 to change the motor capacity. Therefore, the free fall speed can be adjusted or stopped by the remote control valve 8.

In the above-described manner, the motor capacity can be set to a small capacity to thereby wind down and drive the hydraulic motor 2 at high speeds to obtain the free fall function. Therefore, a clutch and a positive brake for the free fall, and a control system therefor are eliminated.

Further, since the pump pressure is set to low pressure simultaneously, the motor speed will not be excessively high. Therefore, it is possible to carry out operation near the original free fall, which is free from looseness of a rope and random winding.

On the other hand, the hydraulic pump 6 is not exclusively used for the hydraulic motor 2 for a winch, as described above, but is used in common as the hydraulic source for one or more actuators not shown. Because of this, engine speed changes with variation of the total load. The pump flow rate is changed by the change of engine speed to change the motor flow rate. Therefore, excessive speed of the motor 2 possibly occurs.

A countermeasure on the above point will be described below.

The winding-down side pilot port 5*b* of the control valve 5 is of a 2-port construction comprising a normal winding-down side port 5*b*1 having a relatively large pressure receiving area, and a free fall side port 5*b*2 having a small pressure receiving area. Pilot pipes 10*a*, 10*b* derived from both the ports 5*b*1, 5*b*2 are connected to a winding-down side pilot line 10 through a mode-switching valve 22 of a hydraulic pilot type.

A pilot port 22*a* of the mode-switching valve 22 is connected to an output port of the free fall valve 15. As shown in FIG. 1, when the free fall valve 15 is at a non-operation position (a), the mode-switching valve 22 is set to a normal winding-down position (a).

When in this state, the winding-down side remote control valve 8 is operated, pilot pressure is supplied to the normal winding-down side port 5*b*1 in the winding-down side pilot port 5*b* of the control valve 5. At this time, the free fall side port 5*b*2 is communicated with a tank T.

Accordingly, in this state, the control valve 5 operates without receiving any restriction at the stroke according to the operating amount (pilot pressure) of the winding-down side remote control valve 8. Thereby, an opening degree of the valve 5 is changed.

Next, when the free fall valve 15 is switched to the operation position (b), the mode-switching valve 22 is switched to the free fall position (b). Thereby, pilot pressure from the remote control valve 8 is supplied to the free fall side port 5*b*2 in the winding-down side pilot port 5*b*of the control valve 5. On the other hand, the normal winding-down side port 5*b*1 is communicated with the tank T.

In this state, a pressure receiving area of the free fall side port 5*b*2 is smaller than that of the normal winding-down side port 5*b*1. Thereby, since the stroke operating force to the winding-down side of the control valve 5 is small, the valve stroke (opening degree) with respect to the operating amount of the winding-down side remote control valve 8 is smaller than that at the time of normal winding-down operation.

Figure 2:
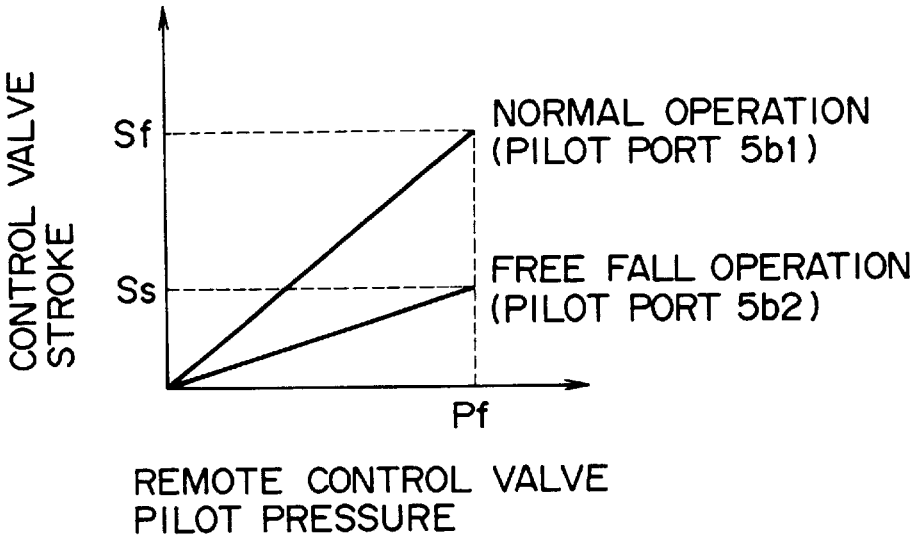
FIG. 2 is a view showing a relationship between pilot pressure from a remote control valve and a stroke of a control valve in Embodiment 1.
Figure 3:
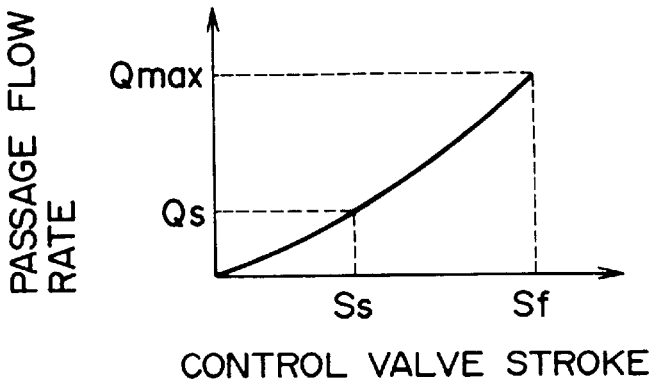
FIG. 3 is a view showing a relationship between the stroke of a control valve and a passage flow rate of the valve in Embodiment 1.

Because of this, as shown in FIG. 2, a stroke (maximum stroke=maximum opening degree) Ss of the control valve 5 at the time of free fall operation with respect to the maximum pilot pressure Pf is smaller than a pulse stroke Sf at the time of normal winding-down operation. Thereby, as shown in FIG. 3, the passage flow rate (maximum passage flow rate=allowable flow rate) Qs of the control valve 5 at the maximum valve stroke Ss is smaller than the maximum passage flow rate Qmax at the time of normal winding-down operation.

Figure 4:
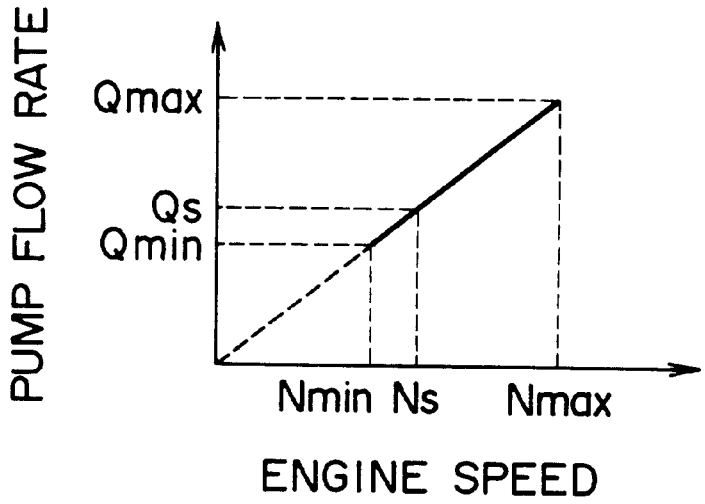
FIG. 4 is a view showing a relationship between engine speed and pump flow rate in Embodiment 1.

Further, as shown in FIG. 4, it is set so that the allowable flow rate Qs is obtained at fixed low speed Ns which is slightly higher than the minimum engine speed Nmin in a relationship between engine speed (minimum valve Nmin, maximum value Nmax) and pump flow rate (minimum valve Qmin, maximum value Qmax).

Figure 5:
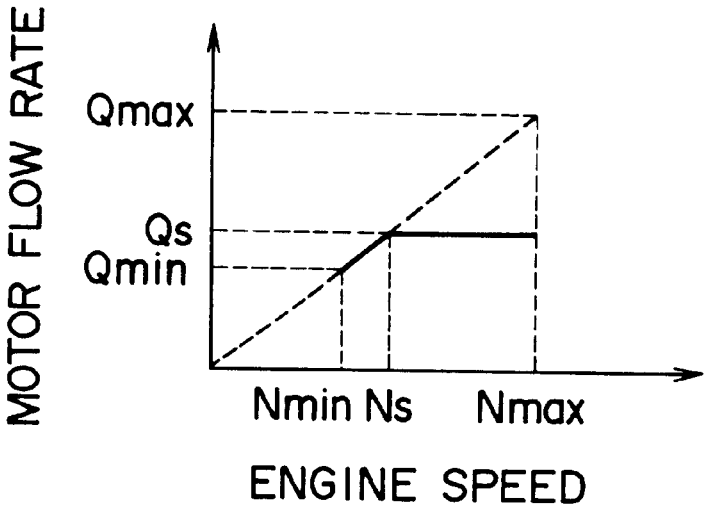
FIG. 5 is a view showing a relationship between engine speed and motor flow rate in Embodiment 1.

Accordingly, as shown in FIG. 5, even if the engine speed exceeds the low speed Ns, the motor flow rate will not increase in excess of the allowable flow rate Qs.

If setting is made as described above, at the time of free fall operation, all the pump flow rate is fed to the hydraulic motor 2 at the low engine speed (less than Ns). On the other hand, in the high engine speed region exceeding Ns, only the allowable flow rate Qs which is a part of the pump flow rate is fed to the hydraulic motor 2.

At this time, a flow rate control valve 23 is provided on the pump line as shown in FIG. 1 in order to return surplus flow rate to the tank T.

According to this constitution, the motor flow rate is suppressed within the allowable flow rate Qs irrespective of variation of engine speed. Therefore, there is no possible occurrence that the hydraulic motor 2 exceeds the allowable speed resulting in excessive speed state or random winding occurs due to the increase in engine speed.

Moreover, the free fall operation can be carried out by the operating means (remote control valve 8) common to normal operation. Because of this, there is no possible occurrence that the operation where the free fall operation from the winding-up operation is continuously carried out becomes complicated or an erroneous operation is brought forth, as in the case where both the operations are carried out by separate operating means.

Figure 6:
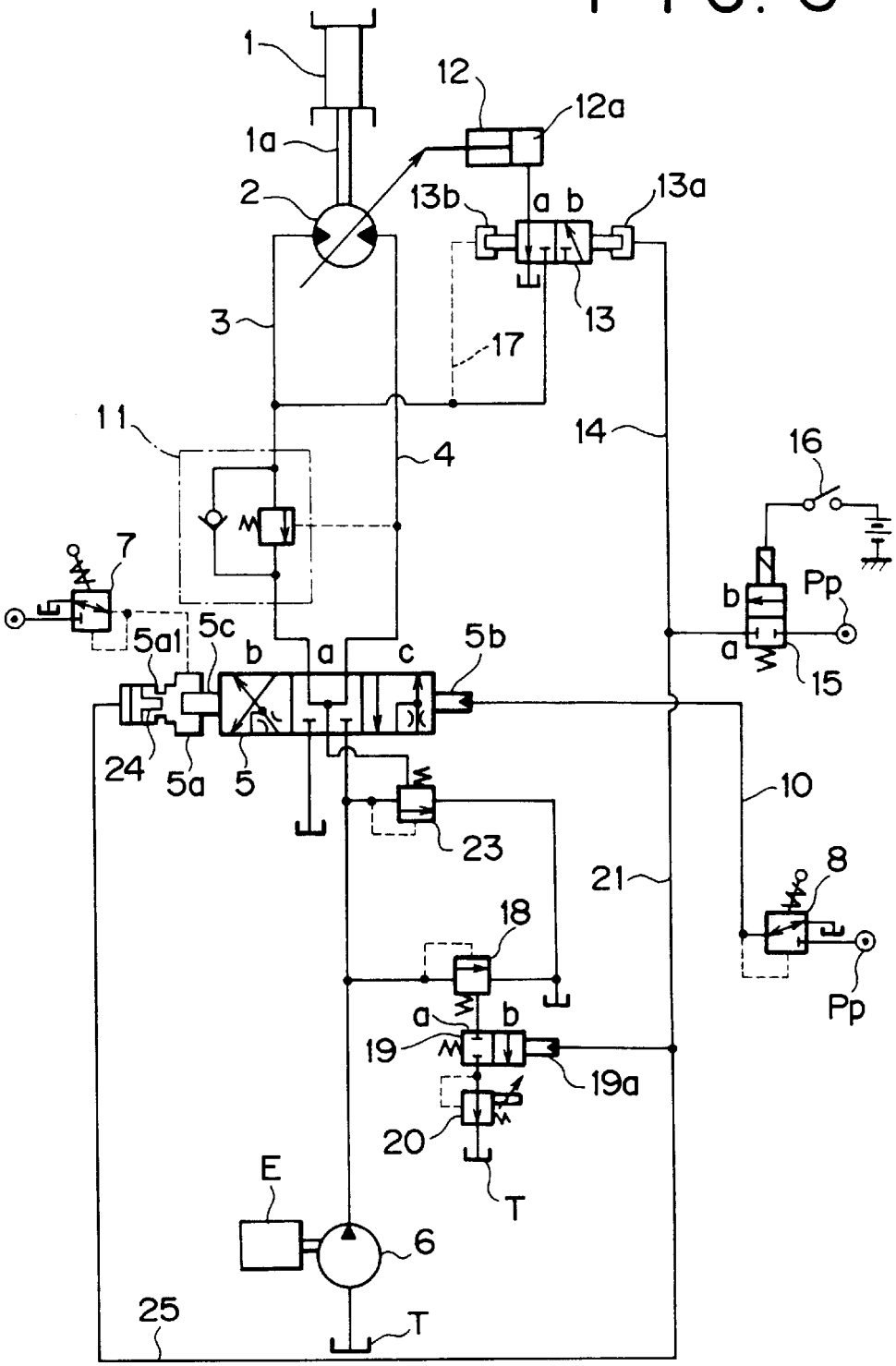
FIG. 6 is a circuit constituent view showing Embodiment 2 of the present invention.

EXAMPLE 2 (See FIG. 6)

In examples 2 to 8 described hereinafter, the same constituent elements as those of example 1 are indicated by the same reference numerals, description of which are omitted.

In example 2, the winding-up side pilot port 5*a* is formed with an auxiliary port 5*a*1. Within the auxiliary port 5*a*1, a stopper 24 is provided movably forward and backward opposing to a spool 5*c*. At the time of free fall operation (when switched to an operating position (b) of the free fall valve 15), oil pressure of the pilot hydraulic source Pp is supplied to the auxiliary port 5*a*1 in the winding-up side pilot port 5*a* through a stopper hydraulic line 25. Thereby, the stopper 24 is moved forward toward the spool 5*c* (in a right direction in the figure) to limit the stroke.

Also in this constitution, the operation and effect similar to that of example 1 can be obtained.

Figure 7:
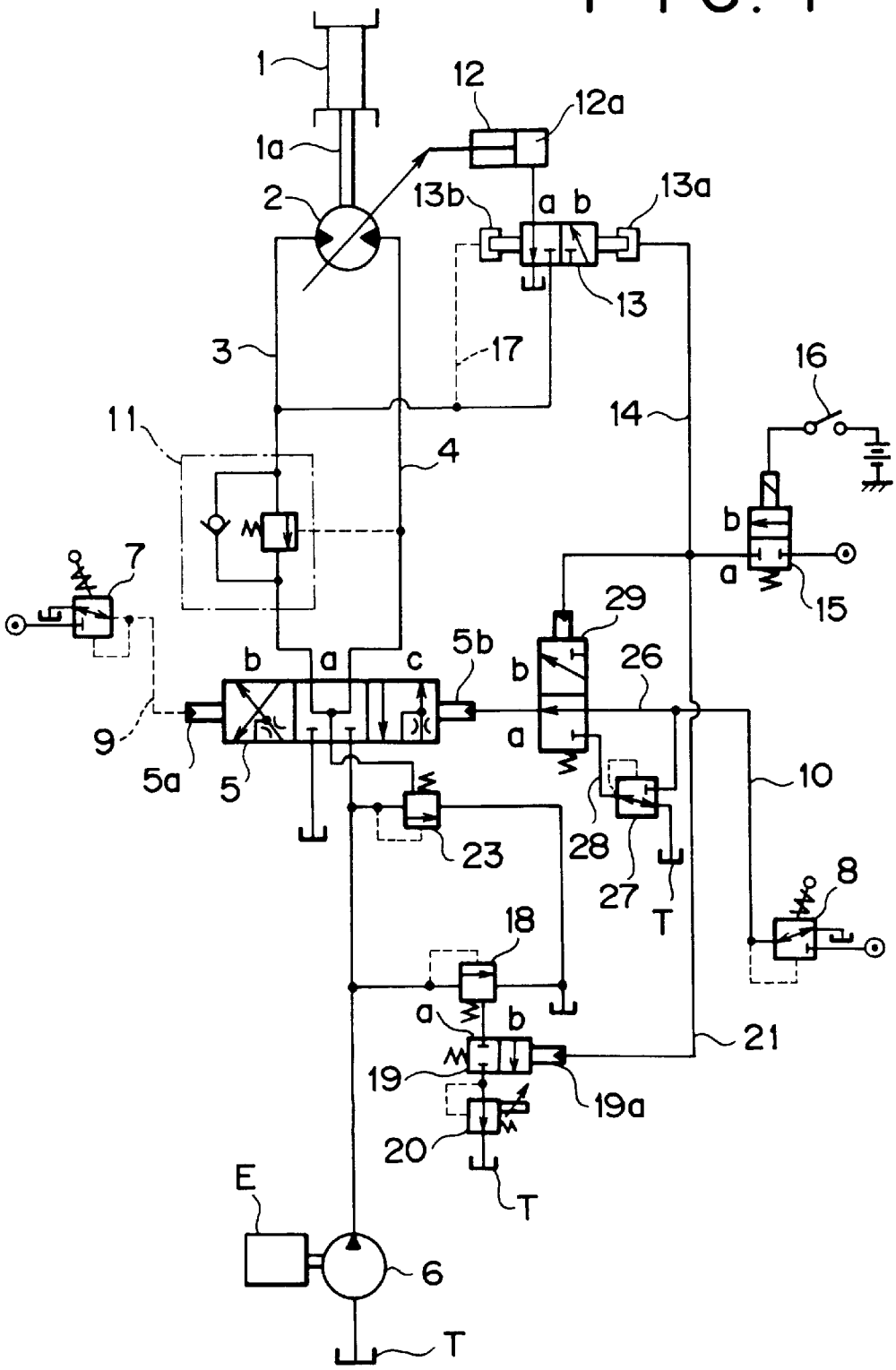
FIG. 7 is a circuit constituent view showing Embodiment 3 of the present invention.
Figure 8:
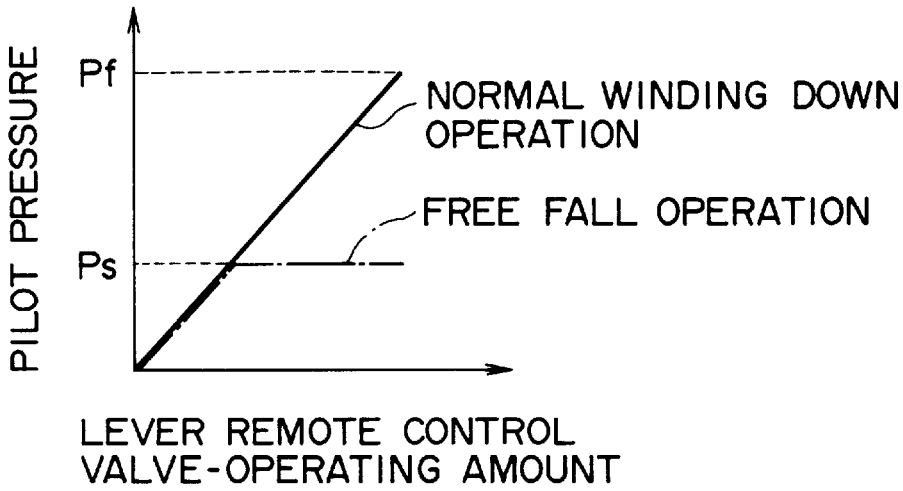
FIG. 8 is a view showing a relationship between a remote control valve operating amount and pilot pressure in Embodiment 3.
Figure 9:
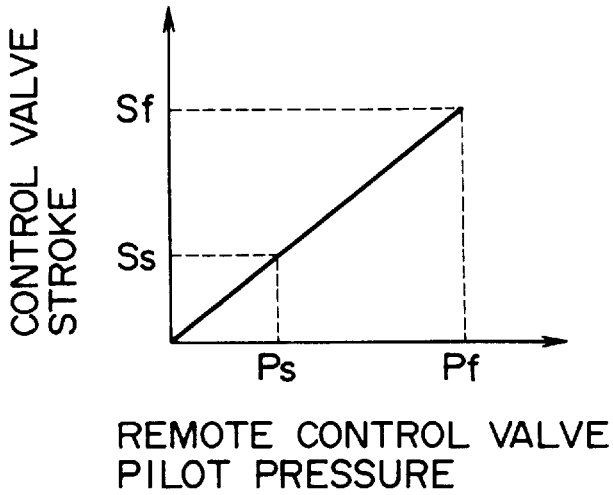
FIG. 9 is a view showing a relationship between remote control valve pilot pressure and a stroke of a control valve in Embodiment 3.

EXAMPLE 3 (See FIGS. 7 to 9)

In the present example, there is employed the constitution that at the time of free fall operation, pilot pressure supplied to the winding-down side pilot port 5*b* of the control valve 5 is suppressed.

That is, the winding-down pilot line 10 is divided into a non-reduction pipeline 26 and a reduction pipeline 28. The non-reduction pipeline 26 causes pilot pressure from the winding-down side remote control valve 8 to pass to the pilot port 5*b* without modification. On the other hand, the reduction pipeline 28 reduces pilot pressure by a reducing valve 27.

A hydraulic pilot type mode-switching valve 29 is provided between both the pipelines 26, 28 and the pilot port 5*b*. Thereby, in the state that the switching valve 29 is set to the normal winding-down position (a), the non-reduction pipeline 26 is communicated with the pilot port 5*b*. As shown by the solid line in FIG. 8, normal pilot pressure (in the figure, Pf denotes the maximum pilot pressure) corresponding to the operating amount of the remote control valve 8.

On the other hand, when the free fall valve 15 is switched to the operating position (b), the mode-switching valve 29 is switched to the free fall position (b). Thereby, as shown by the phantom line in FIG. 8, pilot pressure which is lower than that of the normal winding-down operation (in the figure Ps denotes the maximum pilot pressure at that time) is supplied to the winding-down side port 5*b* of the control valve 5.

FIG. 9 shows a relationship between the pilot pressure set in this embodiment and the control valve stroke. The allowable flow rate (allowable speed) of the motor 2 is obtained by the maximum stroke Ss obtained by the maximum pilot pressure Ps at the time of free fall operation.

Thereby, the motor speed at the time of free fall operation is suppressed to a level not more than the allowable speed, similar to the above examples 1 and 2. Thereby, the excessive speed of the hydraulic motor 2 is prevented.

The specific operation for preventing the excessive speed of the motor according to the present embodiment will be now described. The pilot pressure is introduced into the free fall side port having a small pressure receiving area in the winding-down side pilot port of the control valve, whereby the stroke of the control valve is suppressed to throttle its opening degree. Further, the pilot pressure is introduced into the auxiliary port of the winding-down side pilot port and the stopper is actuated, whereby the stroke of the control valve is suppressed to throttle its opening degree. Further, the pilot pressure from the winding-down operating means (remote control valve) is reduced and is introduced into the pilot port of the control valve, whereby the stroke of the control valve is suppressed to throttle its opening degree.

Furthermore, according to example 3, adjustment and change of the motor allowable flow rate can be done easy by setting the reduction valve 27.

Figure 10:
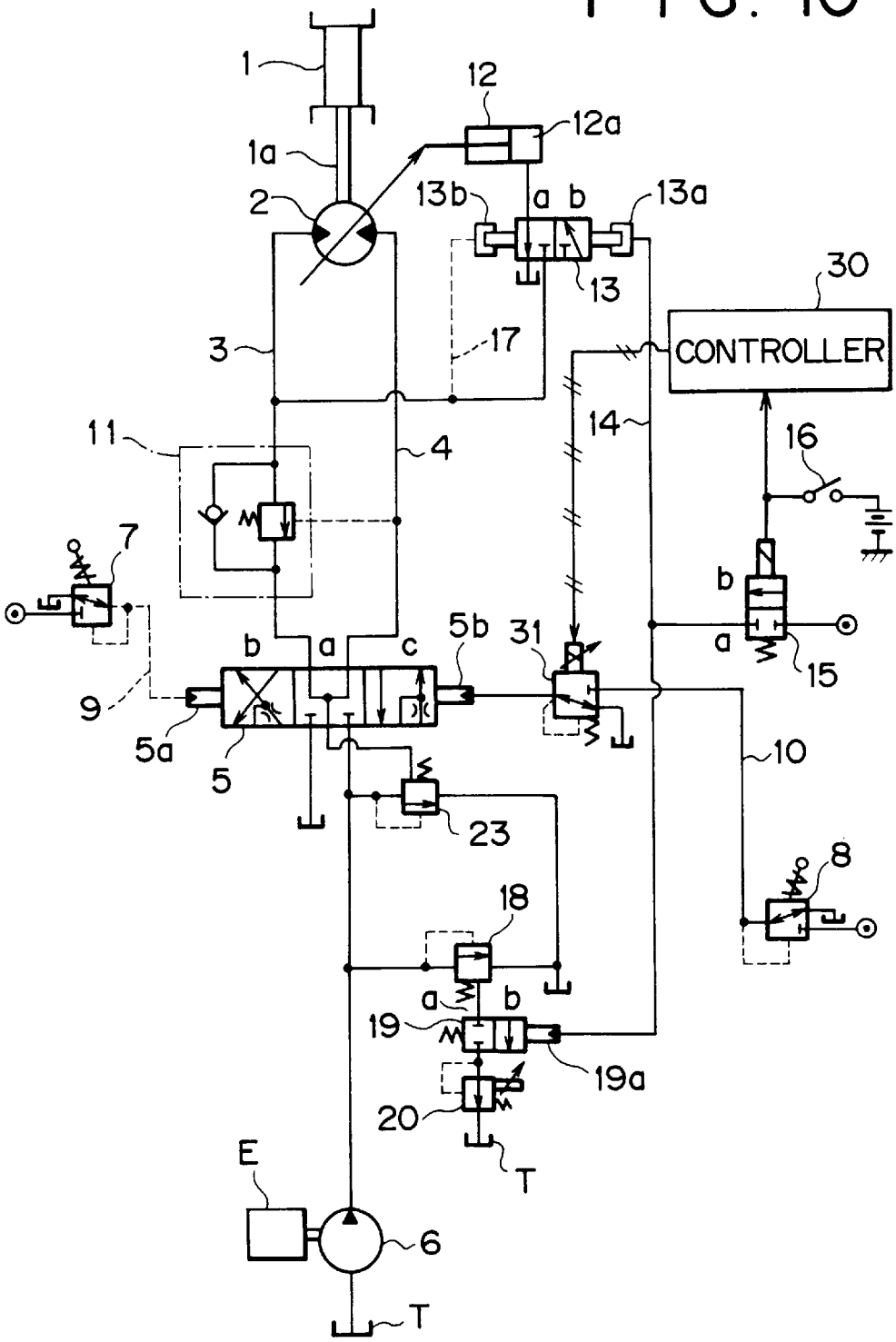
FIG. 10 is a circuit constituent view showing Embodiment 4 of the present invention.
Figure 11:
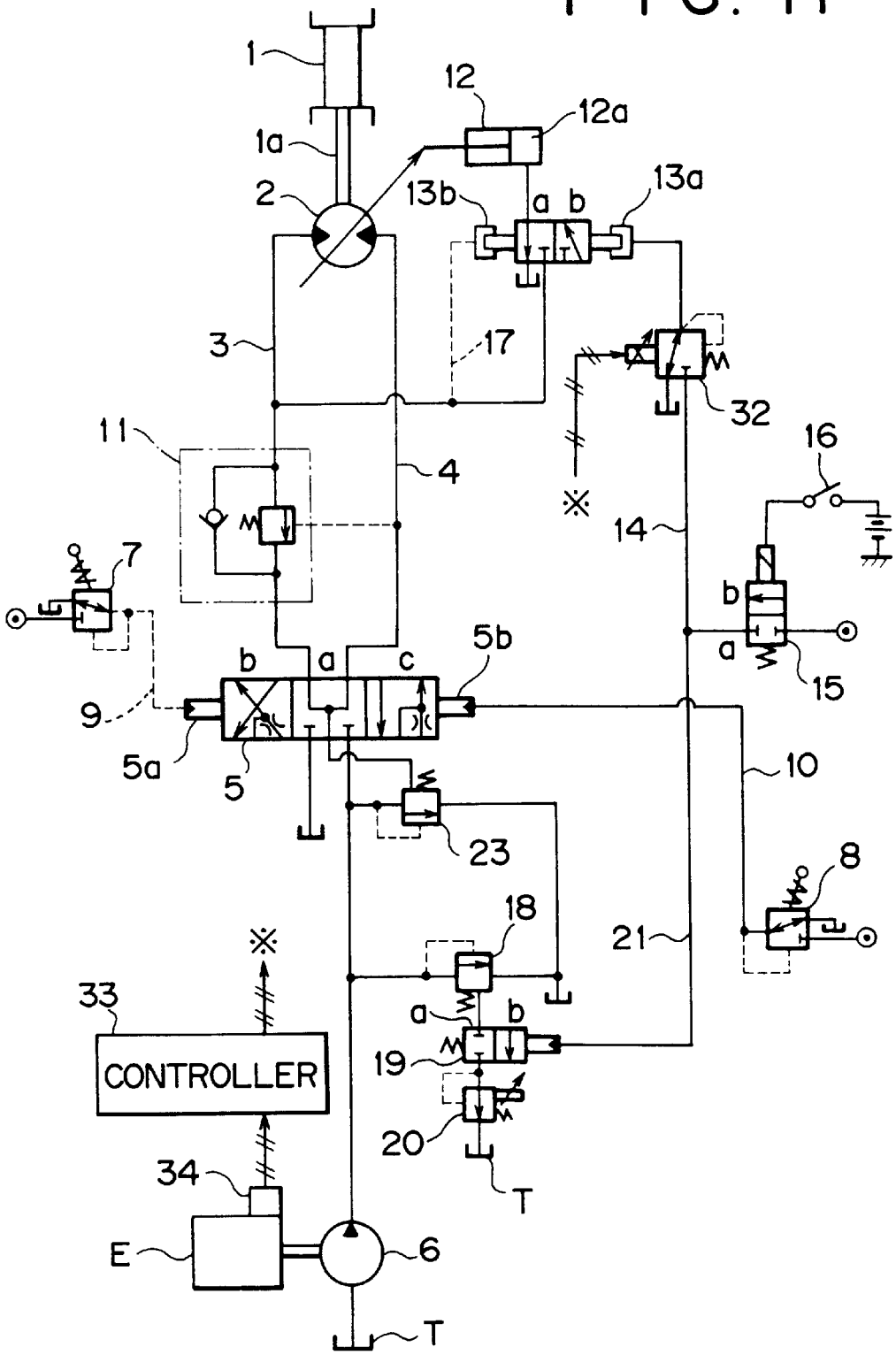
FIG. 11 is a circuit constituent view showing Embodiment 5 of the present invention.

EXAMPLE 4 (See FIG. 10)

An electromagnetic proportional type-reducing valve 31 controlled by a controller is provided in the winding-down side pilot line 10.

The control valve 30 will not output a signal when the free fall switch 16 is turned off (at the time of normal winding-down operation). In this state, the reducing valve 31 is set to high pressure.

On the other hand, when the free fall switch 16 is turned on (at the time of free fall operation) the reducing valve 31 is set to low pressure by a signal from the controller 30.

Thereby, the maximum stroke of the control valve 5 is controlled to Ss in FIG. 9 to prevent the excessive rotation of the motor 2.

EXAMPLE 5 (See FIGS. 11 to 14)

In examples 1 to 4, there is employed the constitution that at the time of free fall operation, the stroke toward the winding-down side of the control valve is controlled to thereby control the motor flow rate. On the other hand, the present embodiment employs the constitution that when the engine speed rises during the free fall operation, the motor capacity is increased to limit the motor rotation.

That is, an electromagnetic proportional type-reducing valve 32 is provided in a motor capacity switching line 14 for switching the motor capacity. Thereby, the reducing valve 32 is controlled by the controller 33.

Figure 12:
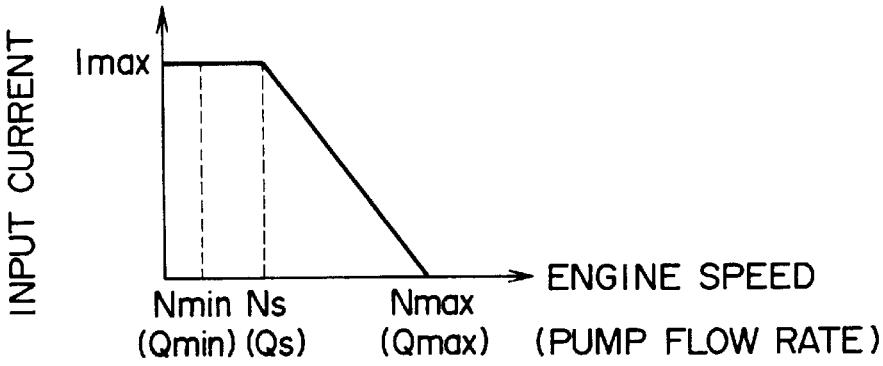
FIG. 12 is a view showing a relationship between engine speed (pump flow rate) and an input current of an electromagnetic proportional reduction valve in Embodiment 5.

The controller 33 changes an output current according to the engine speed detected by a speed sensor 34. As shown in FIG. 12, at not more than the engine speed (hereinafter referred to as the allowable engine speed) at which flow rate Qs corresponding to the motor allowable speed at the time of small capacity of the motor is discharged, full current I max is output. At the engine speed region in excess of the former, it is set so that an output current is reduced in inverse proportion to the engine speed.

Accordingly, at the time of free fall operation, when the engine speed is not more than the allowable speed Ns, oil pressure of the pilot hydraulic source Pp is output by the cylinder control valve 13 from the reducing valve 32 without modification, and the control valve 13 is set to the small capacity position (b). Therefore, the capacity regulating cylinder 12 is extended. Thereby, the hydraulic motor 2 is set to the small capacity q min.

Figure 13:
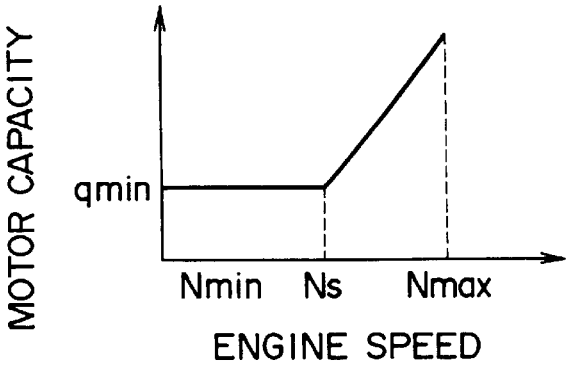
FIG. 13 is a view showing a relationship between engine speed and motor capacity in Embodiment 5.

On the other hand, when the engine speed exceeds the allowable speed Ns, an input current of the reducing valve 32 is reduced in accordance with the setting of FIG. 12. Thereby, the secondary pressure (input pressure of the cylinder control valve 13) lowers. Accordingly, the cylinder control valve 13 is operated toward the large capacity position (a) so that the motor capacity increases as shown in FIG. 13.

Figure 14:
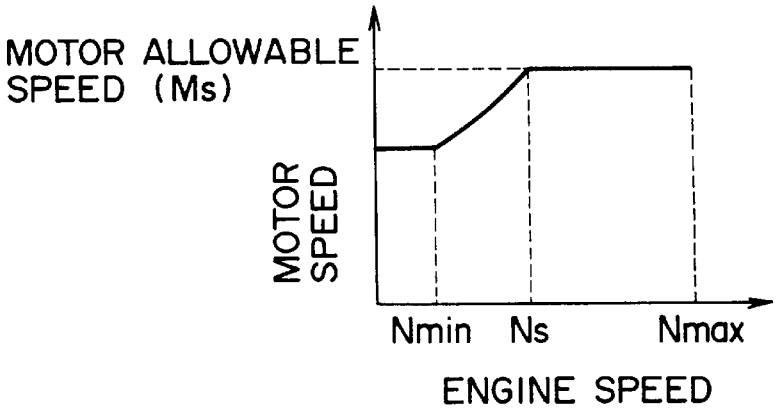
FIG. 14 is a view showing a relationship between engine speed and motor speed in Embodiment 1.

Thereby, as shown in FIG. 14, even if the engine speed increases to the allowable speed Ns or more to increase the motor inflow flow rate, the motor speed does not exceed the allowable speed Ms. (B) Next, a second form of embodiment of this invention will be described hereinafter on the basis of examples 6 to 8.

Figure 15:
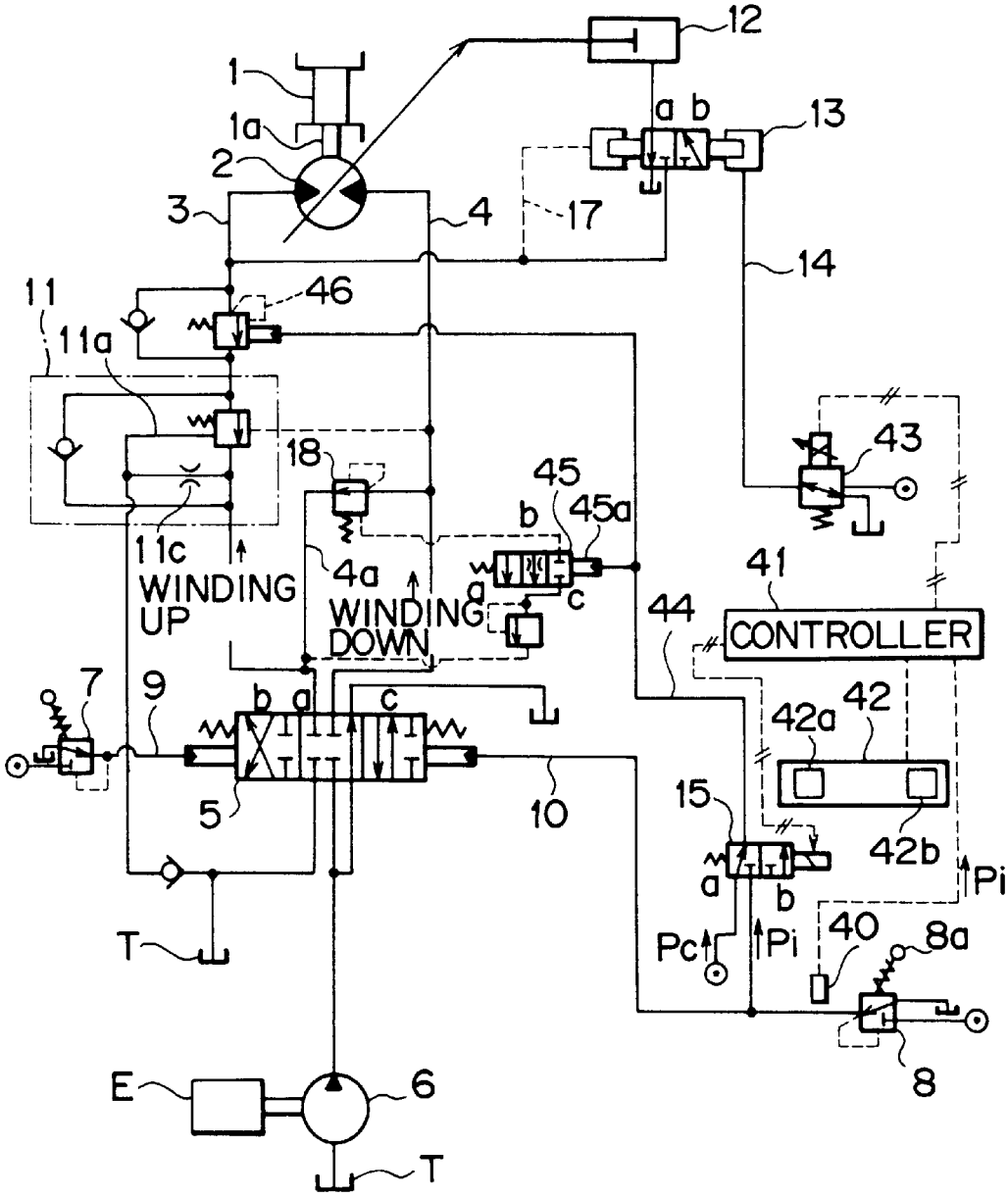
FIG. 15 is a circuit constituent view showing Embodiment 6 of the present invention.
Figure 16:
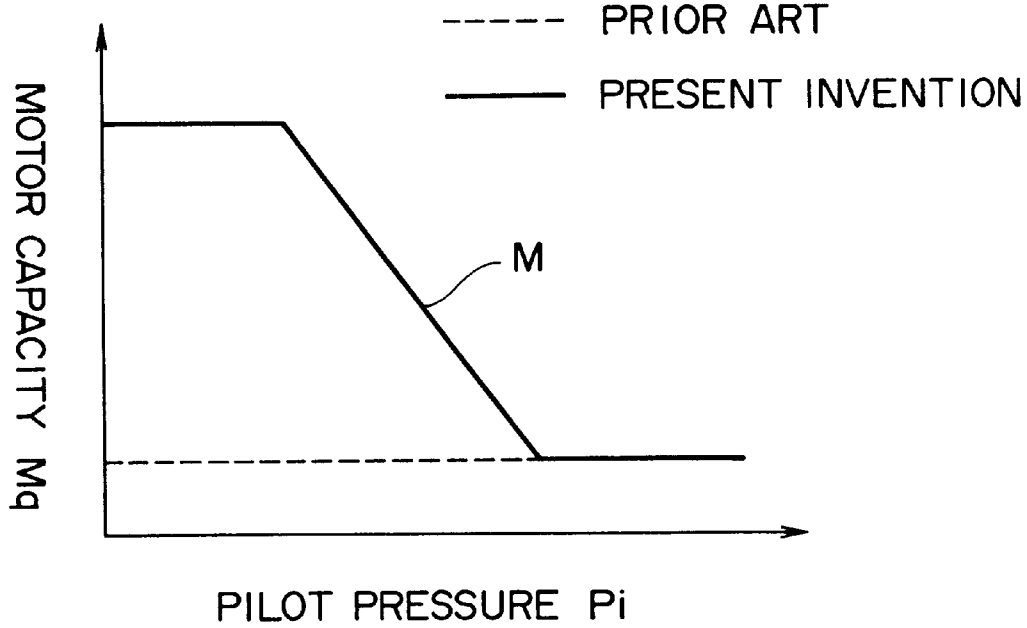
FIG. 16 is a graph showing a relationship between pilot pressure and motor capacity in Embodiment 6.

EXAMPLE 6 (See FIGS. 15 to 17)

In the FIG. 15 constitution, the winding-down initial speed is reduced at the start time of free fall operation, and the winding-down speed can be accelerated according to the operating amount.

In the figure, remote control pressure Pi of the winding-down side remote control valve (operating means) 8 is detected by a pressure sensor 40. A signal output from the pressure sensor 40 is given to a controller 41. A selecting switch (free fall instruction means) 42 is connected to the controller 41. The selecting switch 42 is provided with a normal operating button 42*a* for carrying out normal winding-up and winding-down, and a free fall operating button 42*b*. When the free fall operating button 42*b* is depressed, a free fall instruction is given to the controller 41. Thereby, the controller 41 sets capacity of the hydraulic motor 2 by preset motor capacity characteristics.

FIG. 16 shows the motor capacity characteristics (a relationship between remote control pressure Pi and a motor capacity Mq) set when the free fall instructions are output. As shown in the figure, The motor capacity characteristics M is large when the remote control pressure Pi is small. On the other hand, it is small as the remote control pressure Pi increases.

More specifically, when at the start time of free fall operation, the remote control pressure Pi is small, the controller 41 causes the secondary pressure of a reducing valve 43 (input pressure of the cylinder control valve 13) to lower. Thereby, the cylinder control valve 13 is operated toward the large capacity position (a). Thereby, the motor capacity is set to a large level.

Further, when the free fall instructions is output, the controller 41 causes the free fall valve 15*a* from position (a) to position (b). Thereby, variable remote control pressure Pi in place of fixed pressure Pc is supplied to the pilot oil passage 44.

The remote control pressure Pi is introducing into a set pressure control valve 45 and a holding pressure control valve 46 separately.

The set pressure control valve 45 has a switching position switched from communication to cutoff (in the figure, shown by switching positions a to c conveniently). In the state that the winding-down side remote control valve 8 is not operated when the free fall valve 15 is switched to the position (b), the set pressure control valve 45 is at the position (a). When the winding-down lever 8*a* is operated, the position is switched from the position (b) to position (c).

As the set pressure control valve 45 is switched from the position (b) to position (c), the pressure control valve 18 is changed in set pressure from minimum to maximum. Accordingly, the winding-down pressure (pressure of the winding-down side pipeline 4) changed from minimum to maximum.

On the other hand, the holding pressure control valve 46 is switched to the communication position by the remote control pressure Pi when the free fall operation is selected.

As described above, where the remote control pressure Pi is small, that is, when the operating lever 8*a* starts to be operated in the free fall operation, the motor capacity Mq is made large and the winding-down pressure is made low. In this case, since immediately after the start of free fall operation, the motor capacity Mq is large, much oil is required for the drive of the hydraulic motor 2 whereby the initial speed is slow. As a result, even at the heavy load, the shock generated immediately after the start of free fall winding-down is extremely small. Moreover, it is designed so that the winding-down speed at the time of free fall becomes quick in proportion to the operating amount of the operating lever 8*a*. Therefore, the state can be shifted to the stationary operating state in a stable manner. Accordingly, operation in conformity with an operator's can be carried out.

The controller 41, the free fall valve 15, the set pressure control valve 45 and the pressure control valve 18 function as free fall operation control means.

Figures 17A, 17B:
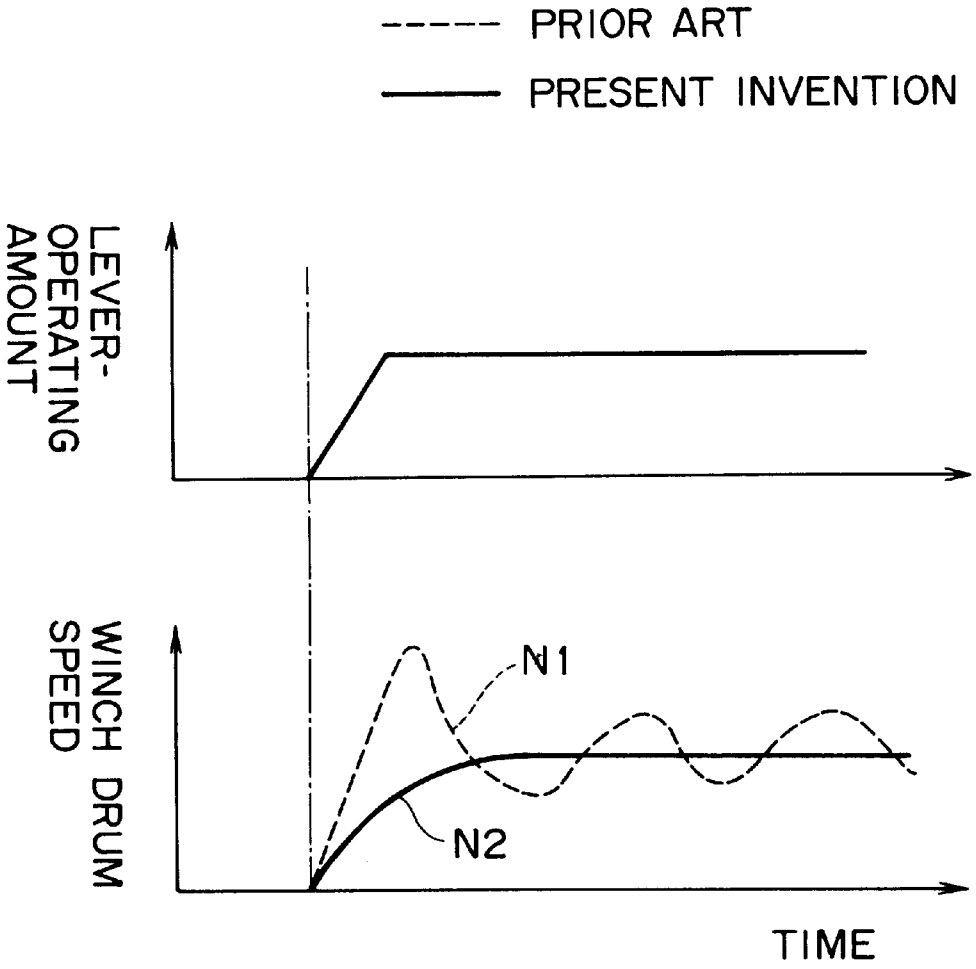
FIG. 17A is a graph showing a lever operating amount in Embodiment 6.
FIG. 17B is a graph for comparing winch drum speed and that of prior art.

FIG. 17A shows the change of the lever-operating amount. FIG. 17B shows the state when the winch drum 1 starts to move.

Pressure of the winding-down side oil path 4 is risen by operation of the lever, and the rotations of the winch drum 1 starts. Where the motor capacity I set to be small when the winding-down starts, the speed of the winch drum 1 rapidly increases (See N1 in FIG. 17). Thereby, the shock possibly occurs depending on the state of a hanging load. However, in the present example, an increase in speed of the winch drum 1 is gentle. Therefore, the state can be shifted to the stationary operating state without being attended by the shock (See N2 in FIG. 17B).

Figure 18:
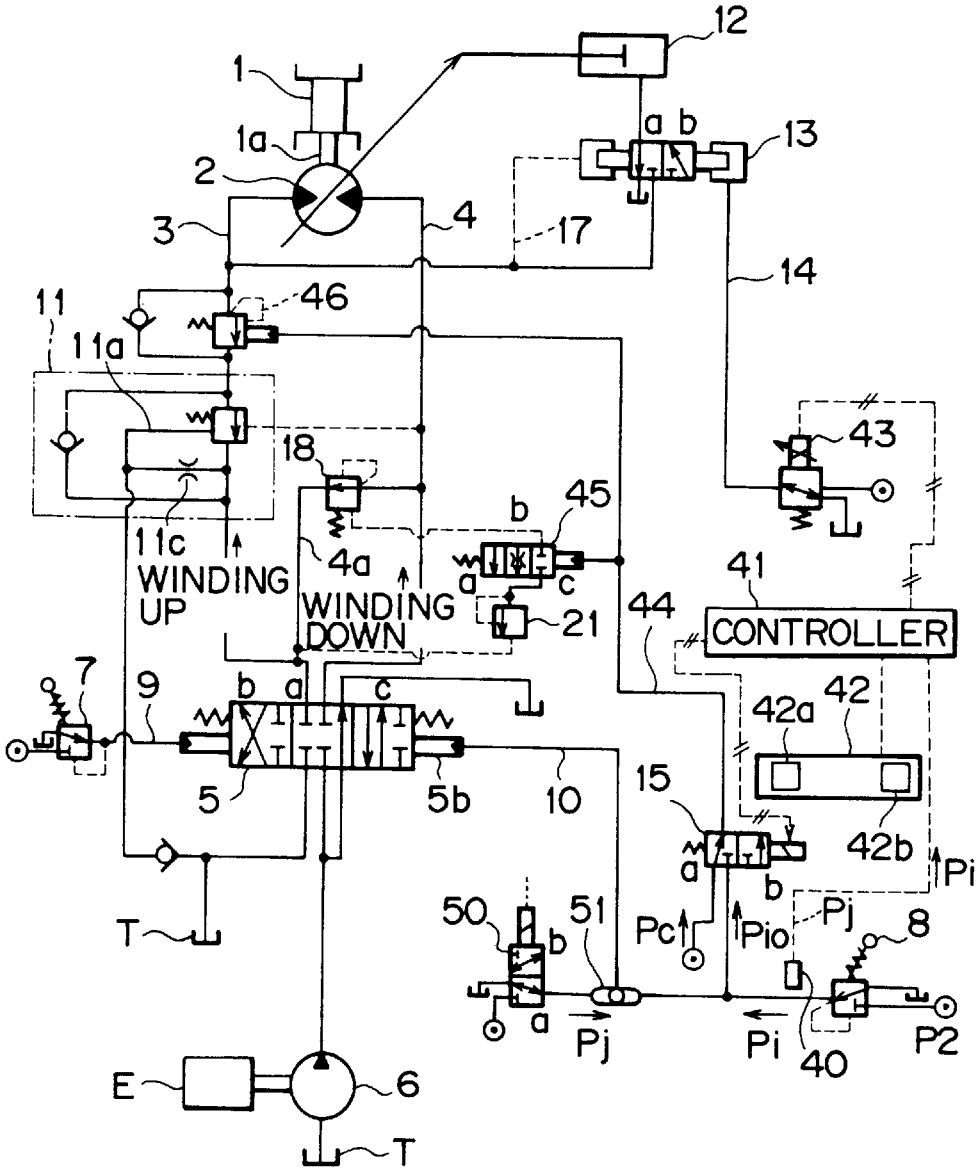
FIG. 18 is a circuit constituent view showing Embodiment 7 of the present invention.

EXAMPLE 7 (See FIG. 18)

In the present example, the control valve 5 is switched by either remote control pressure Pi from the winding-down side remote control valve 8 or pilot pressure Pj from a pilot pressure supply valve (control valve switching means) provided separately from the winding-down side remote control valve 8.

Here, Pj>Pi. Reference numeral 51 denotes a shuttle valve for selecting a high level of the remote control pressure Pi and the pilot pressure Pj.

When a free fall operating button 42*b* of the mode switch 42 is depressed, the controller 41 switches the pilot pressure supply valve 50 from a position (a) to a position (b). Then, when the pilot pressure Pj is derived from the pilot pressure supply valve 50, the shuttle valve 51 selects a high level of the pilot pressure Pj and the remote control pressure Pi. Next, the pilot pressure Pj is given to the pilot port 5*b* of the control valve 5 due to Pj>Pi. Thereby, the control valve 5 is switched to the winding-down position (c) in preference to the operation of the winding-down side remote control valve 8.

In this case, the control valve 5 can be quickly switched to the winding-down position without waiting the remote control pressure Pi from the winding-down side remote control valve 8 at the time of the free fall operation. Accordingly, the time from the start of winding-down to the maximum speed. Thereby, acceleration can be promoted.

It will be appreciated that where the free fall mode is not selected, the pilot pressure Pj is not derived. Thereby, the remote control pressure Pi derived from the winding-down side remote control valve 8 is introduced into the pilot port 5*b* of the control valve 5. Thereby, the winding-up and winding-down operation can be done at normal speeds.

Figure 19:
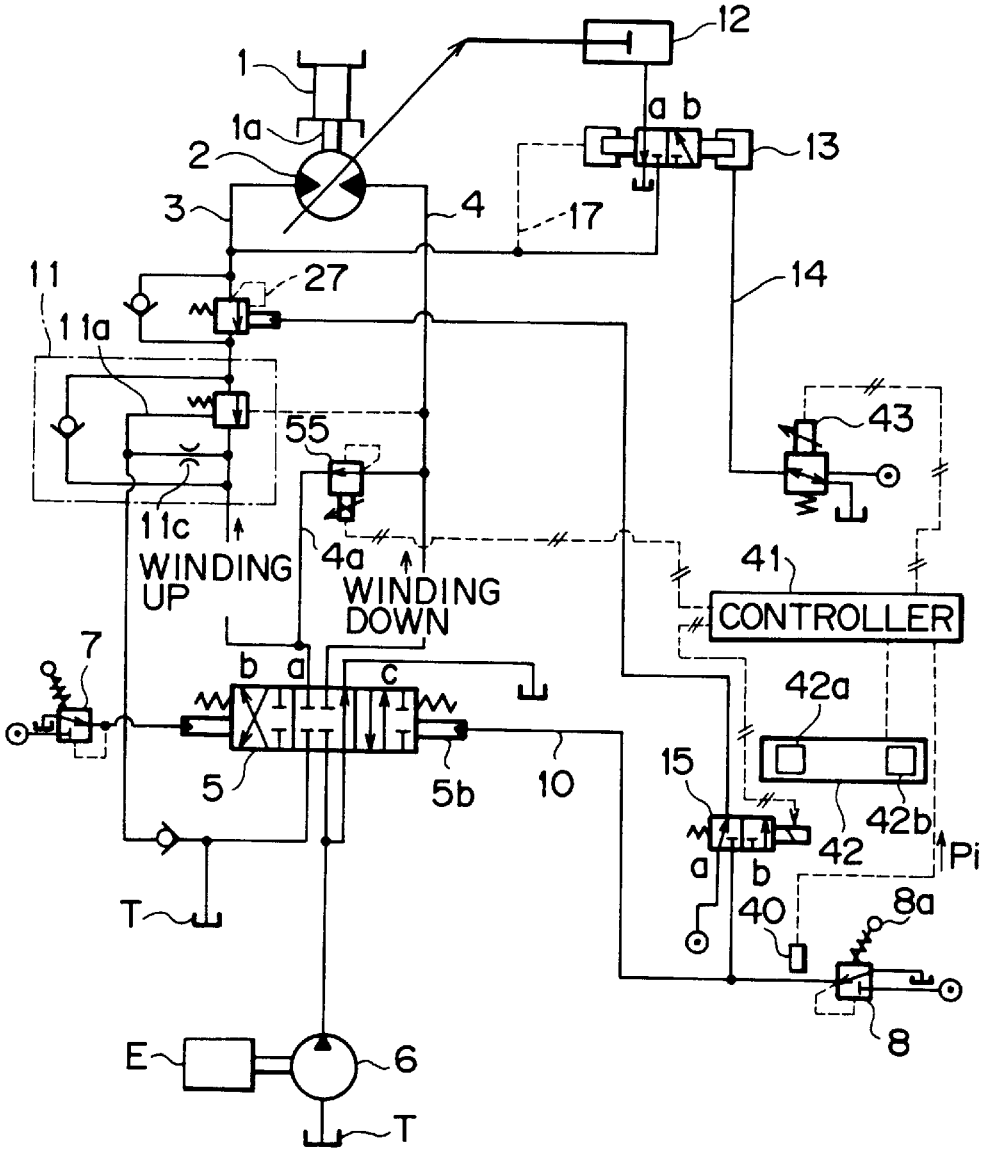
FIG. 19 is a circuit constituent view showing Embodiment 8 of the present invention.
Figure 20:
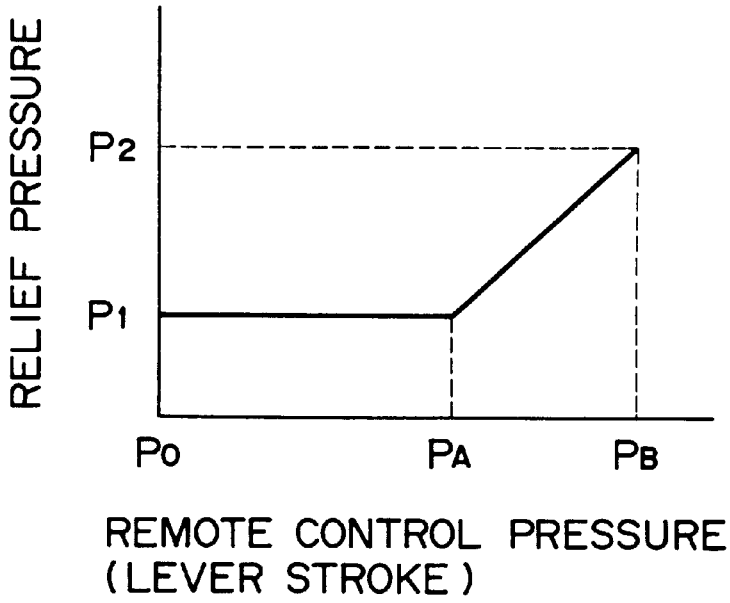
FIG. 20 is a graph showing a relationship between remote control pressure and relief pressure in Embodiment 8.

EXAMPLE 8 (See FIGS. 19 and 20)

In the present example, a relief valve 55 provided on the bypass oil passage 4*a* is directly controlled by the controller 41.

The relief pressure characteristics for changing the relief pressure of the electromagnetic relief valve 55 from low pressure to high pressure in a predetermined pattern according to the lever stroke (remote control pressure Pi) of the operating lever 8*a* is stored in advance in a memory. Thereby, a relief pressure is read out of the memory according to the remote control pressure Pi detected by the pressure sensor 40. Thereby, a relief pressure signal is given to the electromagnetic relief valve 55.

FIG. 20 shows the above-described relief pressure characteristics. A relief pressure P1 is constant when the remote control pressure Pi is from P0 to PA. As the remote control pressure increases from PA to PB, the relief pressure P1 increases from P1 to P2.

According the above constitution, the relief pressure characteristics can be suitably set. Furthermore, there is an advantage that the speed responsiveness is high, and the operation feeling is excellent.

As described above, in the first embodiment, the stroke of the control valve can be suppressed to contract an opening degree thereof by the following means:

(1) In the free fall operation, the pilot pressure is introduced into the free fall side port having a small pressure receiving area in the winding-down side pilot port of the control valve.

(2) In the free fall operation, the pilot pressure is introduced into an auxiliary port of the winding-down side pilot port to actuate a stopper.

(3) In the free fall operation, the pilot pressure from the winding-down operating means (remote control valve) is reduced and introduced into the pilot port of the control valve.

Since the motor capacity is increased according to the rise of the engine, the excessive speed of the motor in the free fall operation can be prevented. Thereby, the random winding can be prevented from occurrence.

Moreover, the free fall operation can be carried out by the same operating means (remote control valve) common to the normal operation. Therefore, the continuous operation particularly where the free fall operation is continuously carried out from the winding-up operation as in the case where both the operations are carried out by separate operating means is not complicated or erroneous operation is possibly brought forth.

The second embodiment has the following effects. That is, when the free fall operation is selected by the free fall instruction means, the tilting angle of the variable capacity type hydraulic motor is controlled. Thereby, the capacity of the hydraulic motor is set to a small capacity from a large capacity in proportional to the winding-down operating amount. Thus, the winding-down operation is carried out using the operating means common in operation to the free fall operation. Since the capacity of the hydraulic motor is large at the time of starting the free fall operation, the initial speed of the free fall is slow. Thereby, the free fall operation can be carried out safely.

At the time of starting the winding-down operation, the pressure of the winding-down side oil passage is set to be low. Therefore, even if the hanging load is large, no shock occurs when the winding-down starts.

The winding-down side oil passage is risen in pressure in proportional to the operating amount of the operating means. Therefore, increasing and decreasing of the hook falling speed can be done according to the operating amount. For example, if the winding-down operating amount is increased in the state that the capacity of the variable capacity type hydraulic motor is set to be small, the free falling can be done at high speeds.

Further, when the free fall operation is started, the control valve switching means independently switches the control valve to the winding-down side. Thereby, the time required from the start of free falling to the maximum winding-down speed in the state that the hanging load is applied is shortened. Accordingly, the responsiveness can be enhanced.

We claim:

1. A control device for a hydraulic drive winch, comprising:

a winch drum;

a variable capacity type hydraulic motor for driving said winch drum;

a hydraulic pump as a hydraulic source for said hydraulic motor;

a control valve for controlling a supply and a discharge of pressure oil to said hydraulic motor;

winding-up operating means for operating said control valve to a winding-up side;

winding-down operating means for operating said control valve to a winding-down side;

motor capacity control means for controlling a capacity of said hydraulic motor;

free fall instruction means for outputting free fall instructions, wherein said motor capacity control means is actuated by free fall instructions from said free fall instruction means to set said hydraulic motor to a small capacity, in which state, said winding-down operating means is operated to thereby rotate said winch drum at high speeds to effect free fall operation; and control valve control means, an opening degree of said control valve relative to an operating amount of said winding-down operating means being controlled to be smaller than that of normal winding-down operation where no free fall instructions is present, wherein in said free fall operation, a flow rate supplied to said hydraulic motor is not more than an allowable flow rate of said hydraulic motor.

2. The control device for a hydraulic drive winch according to claim 1, wherein said control valve is of a hydraulic pilot type provided with pilot ports for both the winding-up side and the winding-down side, respectively, and said winding-down operating means comprises a remote control valve.

3. The control device for a hydraulic drive winch according to claim 2, wherein said control valve control means comprising:

(i) a winding-down side pilot port of said control valve, said winding-down side pilot port having a normal winding-down side port with a relatively large pressure receiving area and a free fall side port with a relatively small pressure receiving area; and (ii) a pilot pressure switching valve, said pilot pressure switching valve introducing a pilot pressure from said winding-down operating means into said normal winding-down side port in case of normal winding-down operation, and introducing it into said free fall side port in case of free fall operation.

4. The control device for a hydraulic drive winch according to claim 2, wherein said control valve control means comprises an auxiliary port provided in a winding-up side pilot port, a pilot pressure being supplied to said auxiliary port at the time of free fall operation; and said auxiliary port has a stopper for controlling a stroke to the winding-down side of said control valve when the pilot pressure is introduced.

5. The control device for a hydraulic drive winch according to claim 2, wherein said control valve control means comprises pilot pressure switching means, said pilot pressure switching means reducing the pilot pressure from said winding-down operating means more than that of the normal winding-down operation at the time of free fall operation to introduce it into the pilot port of said control valve.

6. The control device for a hydraulic drive winch according to claim 2, further comprising:

a reducing valve provided in the winding-down side pilot port of said control valve, said reducing valve being set to a high pressure at the time of normal winding-down operation, and set to a low pressure at the time of free fall operation.

7. A control device for a hydraulic drive winch, comprising:

a winch drum;

a variable capacity type hydraulic motor for driving said winch drum;

a hydraulic pump as a hydraulic source for said hydraulic motor;

a control valve for controlling a supply and a discharge of pressure oil to said hydraulic motor;

winding-up operating means for operating said control valve to a winding-up side;

winding-down operating means for operating said control valve to a winding-down side;

motor capacity control means for controlling a capacity of said hydraulic motor, said motor capacity control means increasing a motor capacity according to an engine speed for driving said hydraulic pump on a high engine speed side to thereby control the speed of said hydraulic motor to not more than an allowable speed of said hydraulic motor at the time of free fall operation; and free fall instruction means for outputting free fall instructions, wherein said motor capacity control means is actuated by free fall instructions from said free fall instruction means to set said hydraulic motor to a small capacity, in which state, said winding-down operating means is operated to thereby rotate said winch drum at high speeds to effect free fall operation.

8. The control device for a hydraulic drive winch according to claim 7, wherein said motor capacity control means comprises:

a motor capacity regulating actuator for changing a capacity of said hydraulic motor;

a hydraulic pilot type actuator control valve for operating said actuator;

a pilot pressure control valve for controlling a pilot pressure introduced into said actuator control valve; and a controller for controlling said pilot pressure control valve according to the engine speed.

9. A control device for a hydraulic drive winch, comprising:

a winch drum;

a variable capacity type hydraulic motor for driving said winch drum;

a hydraulic pump as a hydraulic source for said hydraulic motor;

a control valve for controlling a supply and a discharge of pressure oil to said hydraulic motor;

winding-up operating means for operating said control valve to a winding-up side;

winding-down operating means for operating said control valve to a winding-down side;

motor capacity control means for controlling a capacity of said hydraulic motor;

free fall instruction means for outputting free fall instructions; and free fall control means, said free fall control means changing the capacity of said hydraulic motor from a large capacity to a small capacity in proportional to an operating amount of said winding-down operating means.

10. The control device for a hydraulic drive winch according to claim 9, wherein said free fall control means is designed so that a pressure of winding-down side oil passage leading to said hydraulic motor from said control valve in proportional to the operating amount of said winding-down operating means.

11. The control device for a hydraulic drive winch according to claim 9, further comprising:

control valve switching means switching said control valve to the winding-down side in preference to a switching operation from said winding-down operating means when a free fall operation is selected.

12. The control device for a hydraulic drive winch according to claim 9, further comprising:

a relief valve provided on a bypass oil passage connecting a winding-up pipeline to a winding-down pipeline, a relief pressure of said relief valve being changed in proportional to a operating amount of said winding-down operating means.

* * * * *

UNITED STATES PATENT AND TRADEMARK OFFICE

CERTIFICATE OF CORRECTION

PATENT NO. : 6,648,303 B1
DATED : November 18, 2003
INVENTOR(S) : Yoshio Nishimoto et al.

It is certified that error appears in the above-identified patent and that said Letters Patent is hereby corrected as shown below:

Title page,
Item [73], should read:

-- [73] Assignee: Kobelco Construction Machinery Co., Ltd., Hiroshima (JP) --

Signed and Sealed this

First Day of June, 2004

JON W. DUDAS
*Acting Director of the United States Patent and Trademark Office*